US009635965B2

(12) United States Patent
Murray

(10) Patent No.: US 9,635,965 B2
(45) Date of Patent: May 2, 2017

(54) FITMENT WITH SPOON

(71) Applicant: Pouch Pac Innovations, LLC, Sarasota, FL (US)

(72) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 128 days.

(21) Appl. No.: 14/295,616

(22) Filed: Jun. 4, 2014

(65) Prior Publication Data

US 2014/0353182 A1 Dec. 4, 2014

Related U.S. Application Data

(60) Provisional application No. 61/830,887, filed on Jun. 4, 2013.

(51) Int. Cl.

| | |
|---|---|
| ***A47G 21/00*** | (2006.01) |
| ***B65D 35/28*** | (2006.01) |
| ***B65D 75/58*** | (2006.01) |
| ***B65D 51/24*** | (2006.01) |

(52) U.S. Cl.
CPC ..... *A47G 21/004* (2013.01); *B65D 51/246* (2013.01); *B65D 75/5883* (2013.01)

(58) Field of Classification Search
CPC . B65D 75/5883; B65D 51/246; A47G 21/004
USPC ..... 206/541, 553, 216; 222/192
See application file for complete search history.

(56) References Cited

U.S. PATENT DOCUMENTS

| | | | | |
|---|---|---|---|---|
| 2,175,735 | A * | 10/1939 | Banks | A47G 19/186 220/735 |
| 2,485,303 | A * | 10/1949 | Marcus | B01F 7/00333 220/735 |
| 2,953,170 | A * | 9/1960 | Bush | B65D 51/246 222/205 |
| 4,091,965 | A | 5/1978 | Gebhard | |
| 5,673,789 | A * | 10/1997 | Degraff-Eugene | A47G 19/2205 206/217 |
| 7,374,046 | B1 | 5/2008 | O'Brien | |
| 2003/0029868 | A1* | 2/2003 | Davidov | B65D 51/185 220/212 |
| 2006/0076252 | A1* | 4/2006 | Witkowski | A47G 21/182 206/223 |
| 2010/0147885 | A1 | 6/2010 | Braxton et al. | |

FOREIGN PATENT DOCUMENTS

| | | | | |
|---|---|---|---|---|
| JP | 2005118522 | * | 5/2005 | A47G 21/18 |

* cited by examiner

*Primary Examiner* — Chun Cheung
(74) *Attorney, Agent, or Firm* — Dinsmore & Shohl LLP

(57) ABSTRACT

Containers having a fitment have been used to store food product. Oftentimes the product contained within the container is easier for a user to consume if a utensil such as a spoon is used. The present disclosure is directed towards an assembly for mounting to a container. The assembly includes a fitment with a passage. The spoon is at least partially disposed within the passage of the fitment. The spoon may be attached to the fitment, and covered by a protective cover. The protective cover may include a first half and a second half. The protective cover can be secured with a safety seal.

19 Claims, 4 Drawing Sheets

FITMENT WITH SPOON

CROSS-REFERENCE TO RELATED APPLICATIONS

This application depends from and claims priority to U.S. Provisional Application No. 61/830,887 filed Jun. 4, 2013, which is incorporated herein by reference.

FIELD OF THE INVENTION

The present disclosure relates to the field of food product containers. More particularly, the present disclosure is in the field of fitments for containers that are intended to hold food items such as baby food, yogurt, mashed fruits and vegetables, applesauce and other similar products that might necessitate the use of a spoon for easy consumption.

BACKGROUND OF THE INVENTION

Containers having a fitment with a tube spout have been used to store food product such as such as baby food, yogurt, mashed fruits and vegetables, applesauce, etc. for quite some time. Oftentimes the product contained within the container is easier for a user to consume if a utensil such as a spoon is used. For example, if the product can be removed from the container via the tube spout of the fitment and placed directly onto a spoon. Once on the spoon the product can neatly be consumed by the user. However, at times a spoon may not be available for the user. In such cases a new design which provides a spoon to the user is desired.

SUMMARY OF THE INVENTION

The present disclosure is directed towards an assembly for mounting to a container. The assembly includes a fitment with a passage. The fitment is for mounting to the container such that one end of the passage is in communication with the interior of the container. The passage also includes an opposite end. The assembly further includes a spoon. The spoon is at least partially disposed within the passage of the fitment.

The spoon may be attached to the fitment, and covered by a protective cover. The protective cover may include a first half and a second half. The protective cover may be secured with a safety seal, may be hinged at a top part of the cover, and may be hinged at a bottom part of the cover.

DETAILED DESCRIPTION OF THE INVENTION

Figure 1:
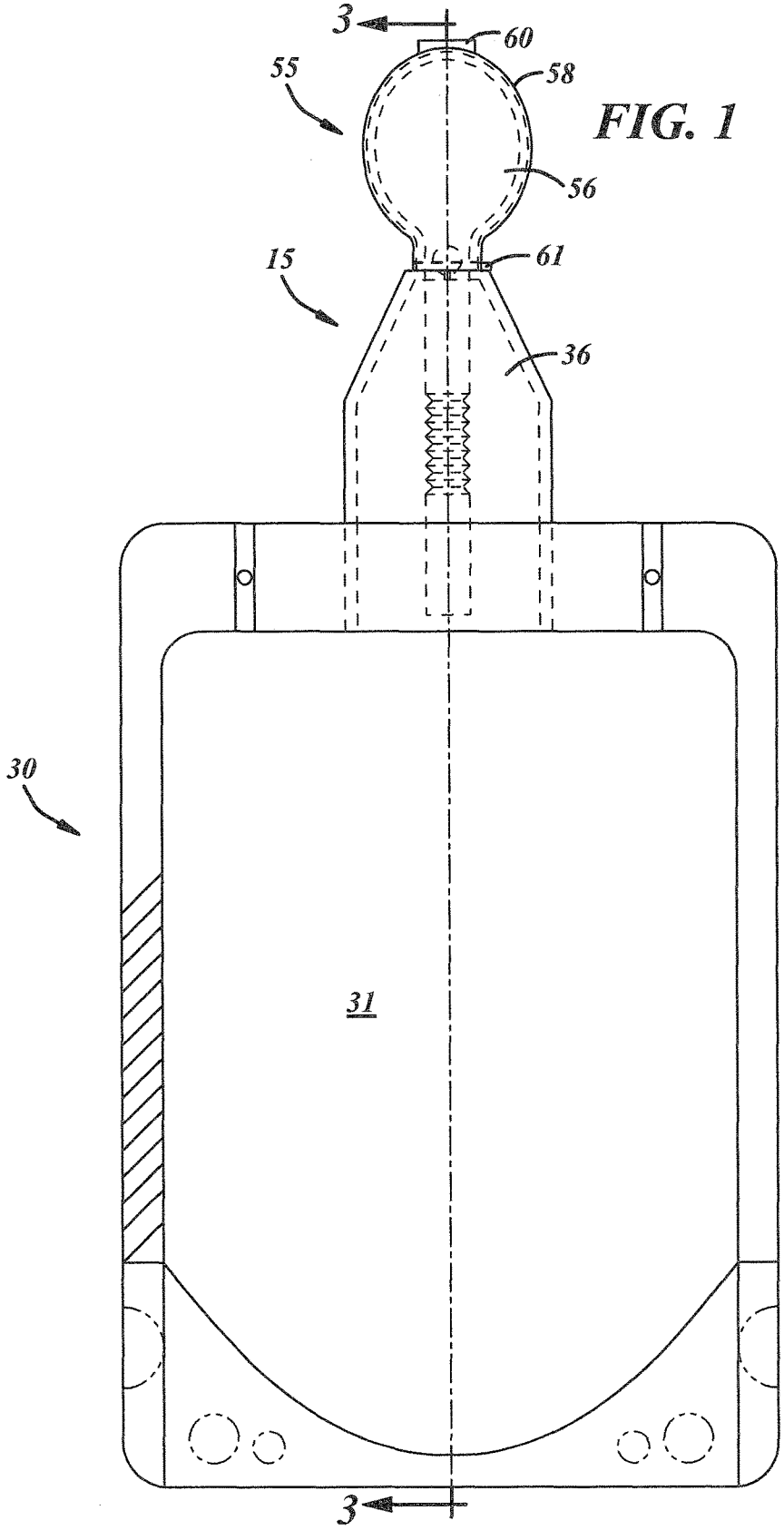
FIG. 1 is an elevational front view of a container having an assembly of the present disclosure including a cover.

An assembly for mounting to a container includes a fitment 15 with a passage 20. When the fitment 15 is mounted to the container, one end 21 of the passage 20 is in communication with an interior of the container. The passage also includes an opposite end 22. A spoon 25 is at least partially disposed within the passage 20 of the fitment 15.

Figure 2:
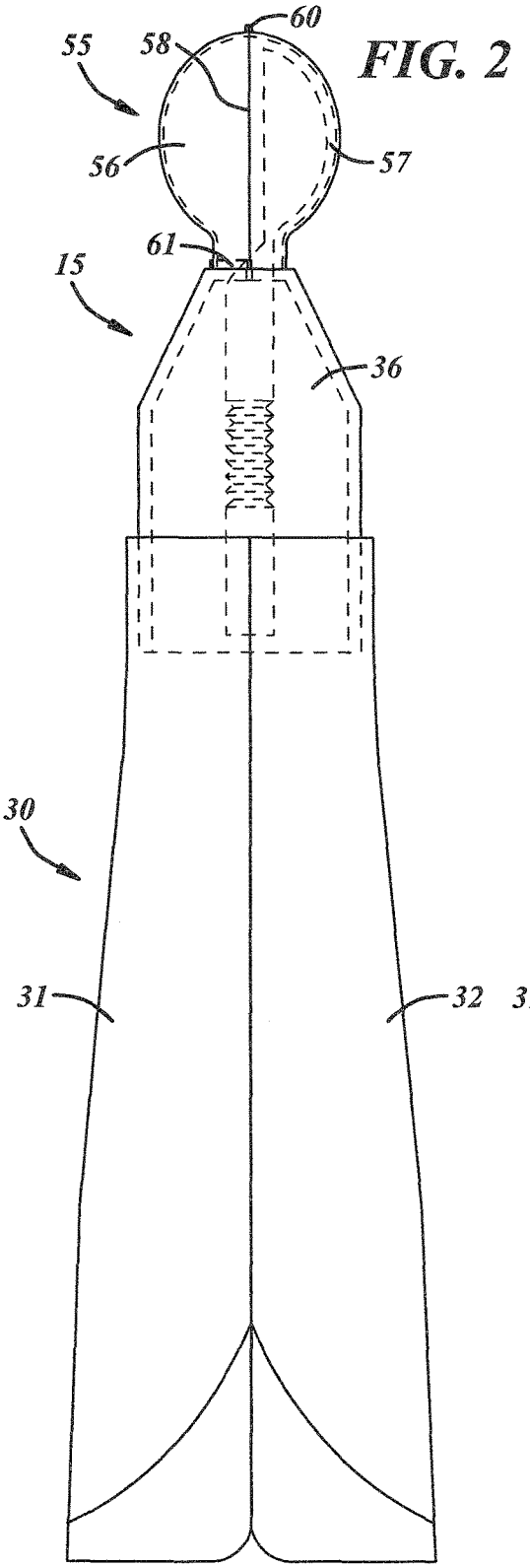
FIG. 2 is an elevational side view of the container having the assembly of FIG. 1.
Figure 3:
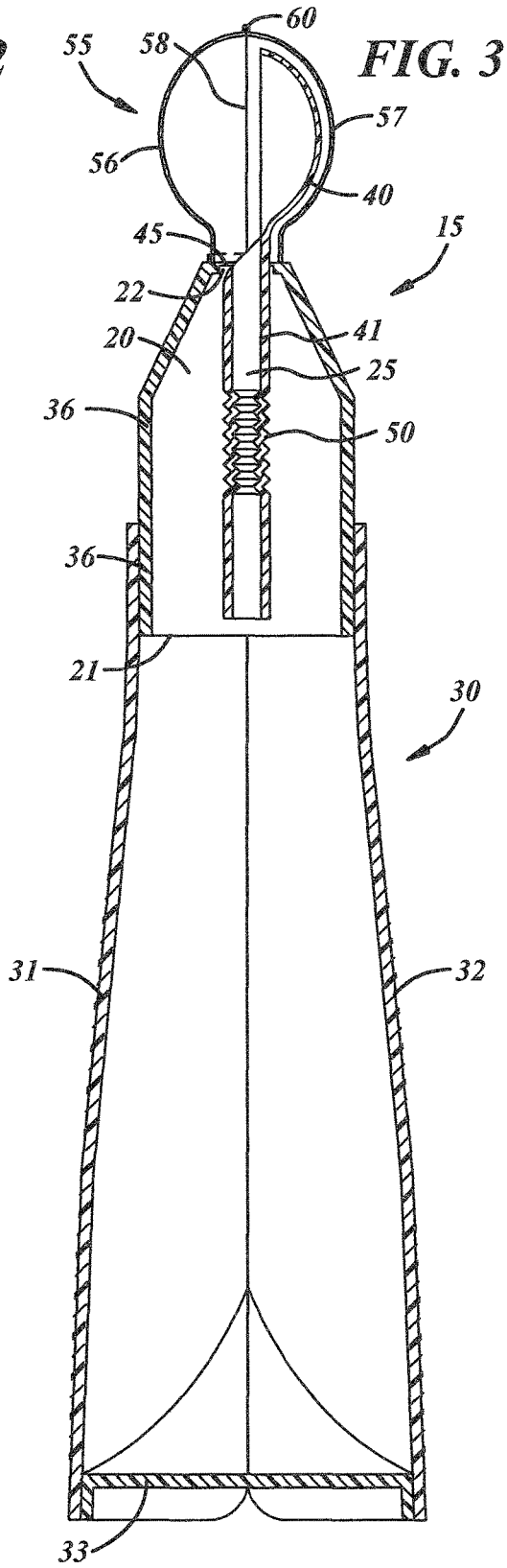
FIG. 3 is a sectional side view of the container having the assembly of FIG. 1.

One embodiment of the container, as shown in FIGS. 1-3, is a flexible pouch 30. The flexible pouch 30 includes a front panel 31 and a back panel 32. The fitment 15 is disposed between the front panel 31 and the back panel 32 at a top portion to the flexible pouch 30. A gusset 33 is disposed between the front panel 31 and the back panel 32 and at a bottom portion of the flexible pouch 30. The front panel 31 and back panel 32 are sealed to each other, the fitment 15, and the gusset 33, in a sealed area that runs along the perimeter of the flexible pouch 30. The front panel 31, back panel 32, gusset 33 and fitment 15 define the interior of the flexible pouch 30.

The flexible pouch 30 is made from a flexible material, preferably a laminate composed of sheets of plastic or aluminum or other suitable materials. The front panel 31 and back panel 32 can be separate sheets of the flexible material, or can be a single sheet folded over. An outer layer of the material may include preprinted information, such as a logo or the like, to provide the consumer with information regarding the contents of the pouch. The pouch 30 may be formed and/or filled using conventionally known manufacturing techniques, such as a horizontal form-fill-seal machine with a single or multiple lanes, a flat bed pre-made pouch machine, a vertical form-fill machine, or the like. An example of a method and apparatus for filling a flexible pouch with a product is disclosed in commonly assigned U.S. Pat. No. 6,199,601, which is incorporated herein by reference. The edges of the pouch are sealed, leaving an edge open for receiving a fitment. The spout fitment is inserted into the opened edge and the open edge is ultrasonically or heat-sealed, so as to seal the fitment to the walls of the pouch.

One embodiment of the fitment 15 includes a canoe portion 35 and a spout portion 36. The canoe portion 35 of the fitment 30 is disposed between, and sealed to, the front panel 31 and back panel 32 of the flexible pouch 30. The spout portion 36 extends from the canoe portion 35. The passage 20 extends through both the canoe portion 35 and the spout portion 36. The passage 20 includes one end 21 in communication with the interior of the flexible pouch, and the opposite end 22. The passage 20 allows product to the added or removed from the interior of the flexible pouch 30. Partially disposed within the passage 20 of the fitment 15 is the spoon 25.

The spoon 25 includes a scoop portion 40, and a handle portion 41. The scoop portion 40 is disposed above the spout portion 36, with the handle portion 41 of the spoon 25 fully received into the passage 20 of the fitment 15. The spoon 25 and fitment 15 can be made of injection molded plastic, or any other material and/or method known to those skilled in the art.

In the shown embodiment, the spoon 25 is secured within the passage 20 by one or more frangible ribbons 45. The frangible ribbons 45 extend axially from the spoon 25 and secure to an inside surface 46 of the spout portion 36 of the fitment 15. The ribbons 45 are thin enough in manufacture such that a user can twist or pull the spoon 25 to break the ribbons 45, thereby detaching the spoon 25 from the fitment 15. The ribbons 45 extend from the spoon 20 in an area between an extendable portion 50 of the handle portion 41 and the scoop portion 40 of the spoon 25.

The extendable portion 50 is generally located at a middle of the handle portion 41. The extendable portion 50 has a concertina type design, enabling the handle portion 41 to be extended by a user pulling in opposite longitudinal directions from each end of the handle portion 41, thereby allowing the handle portion 41 to have a more compact shape when attached to the fitment 15, and a longer, more user friendly shape, when detached for use.

Also attached to the fitment 15 is a protective cover 55. The protective cover 55 is disposed above the spout portion 36 of the fitment 15, and encloses the scoop portion 40 of the spoon 25 not disposed within the passage 20.

The first half 56 and second half 57 are generally hemispherical in shape, and are oriented in a clamshell style design. The clamshell design provides that the protective cover 55 can be transitioned from a closed position, as exampled in FIGS. 4 and 6, to an open position, as exampled in FIGS. 5 and 7. The hemispherical shape of the first half 56 and the second half 57 allows the protective cover 55 to be secured to the fitment 15 regardless of the rotational position, or orientation, of the spoon 25 within the passage 20.

Figure 4:
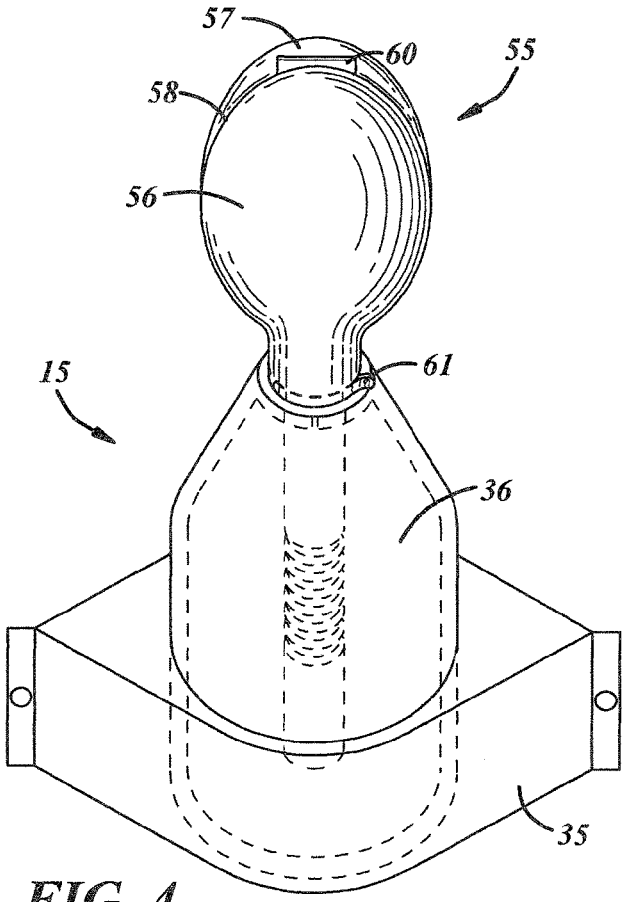
FIG. 4 is a perspective front view of the assembly of FIG. 1 with the cover in a closed position.
Figure 5:
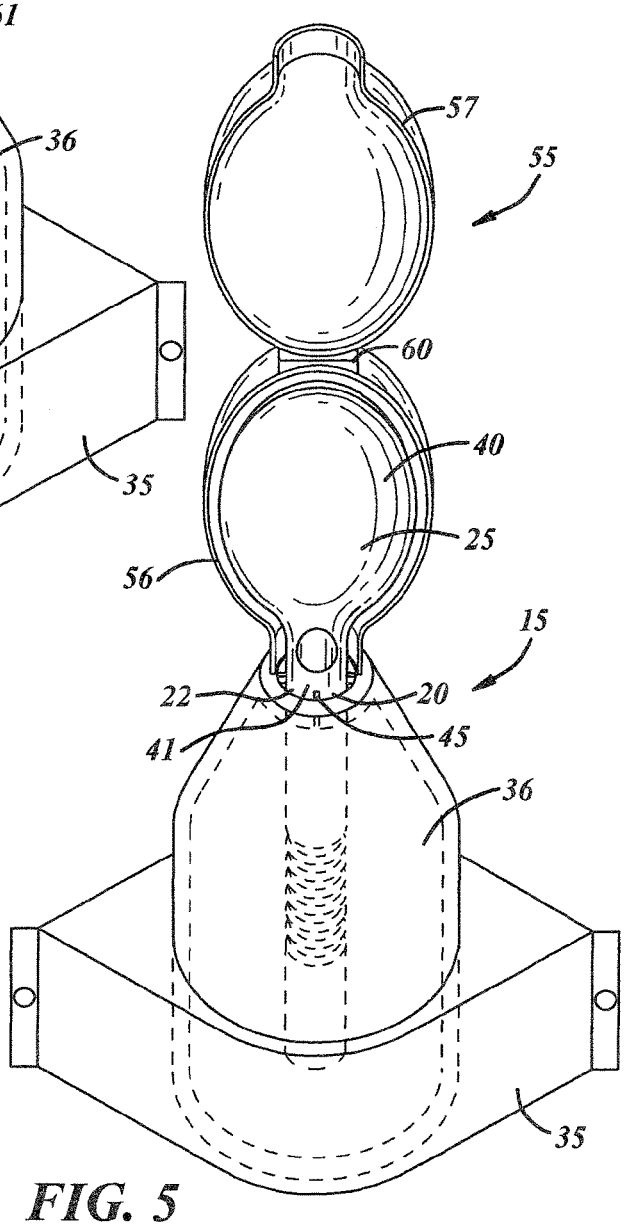
FIG. 5 is a perspective front view of the assembly of FIG. 1 with the cover in an open position.

In one embodiment, as shown in FIGS. 4-5, the cover 55 includes a first half 56 and a second half 57. The first half 56 and second half 57 are secured to the spout portion 36 of the fitment 15, and extend upwardly to envelope the spoon 25. The first half 56 abuts the second half 57 along a cover seam 58. The cover seam 58 can be a physical separation between the first and second halves 56 57, or it can be a detachable type connection, such as an area of thin frangible material capable of being broken, torn, or otherwise removed or detached to enable separation of the halves 56 57.

The first half 56 is attached to the second half 57 at the top of the first and second halves 56 57 by a top hinge 60. The first half 56 is attached to the fitment 15 by way of a detachable portion, such as a tear away safety seal 61. The safety seal 61 attaches to the fitment 15 and the first half 56 by way of an area of thin frangible material capable of being broken to enable separation. The second half 57 is securely attached to the fitment 15. To access the spoon 25, the safety seal 61 is removed, detaching the first half 26 from the fitment 15. The first half 26 is pivoted about the top hinge 60, separating the first half 56 from the second half 57 along the cover seam 58, and providing access to the spoon 25.

Figure 6:
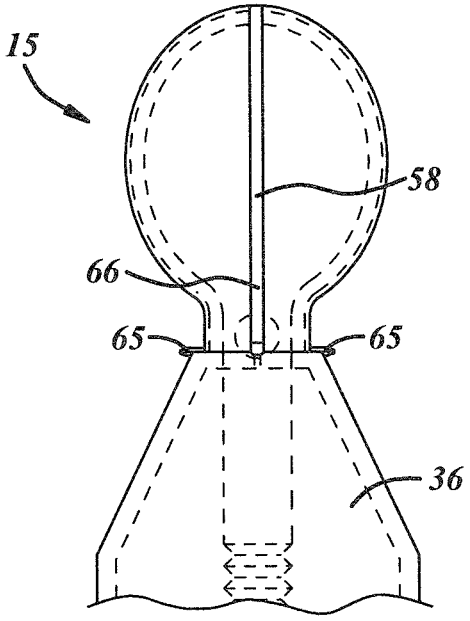
FIG. 6 is an elevational front view of a portion of an assembly of the present disclosure with an alternate cover in a closed position.
Figure 7:
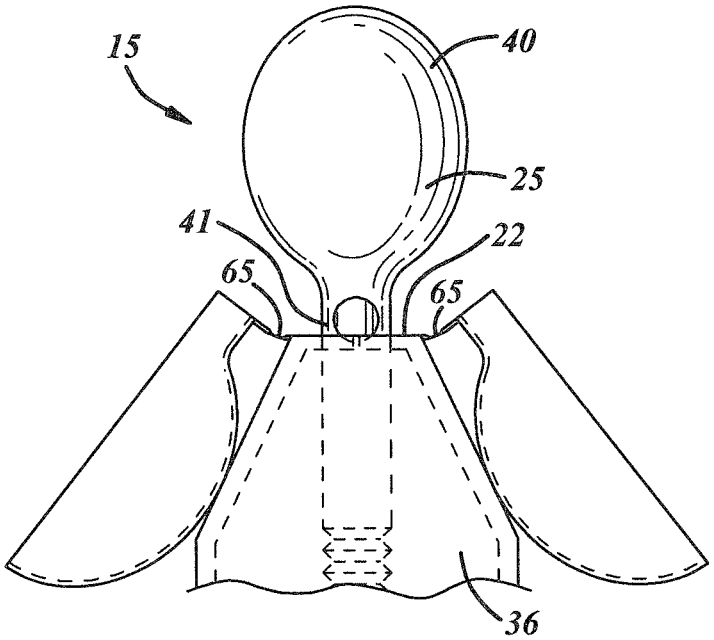
FIG. 7 is an elevational front view of the portion of the assembly of FIG. 4 with the alternate cover in an open position.

In another embodiment, as shown in FIGS. 6-7, the first half 56 and second half 57 are each attached to the fitment 15 by way of a bottom hinge 65. An alternate detachable portion, such as an alternate tear away safety seal 66, attaches the first half 56 to the second half 57. The alternate safety seal 66 runs along the cover seam 58. To access the spoon 25, the alternate safety seal 66 is removed, detaching the first half 56 from the second half 57. Once detached from each other, the first half 56 and second half 57 are free to pivot about their respective bottom hinge 65, thereby separating the first half 56 from the second half 57, and providing access the spoon 25.

The fitment 15, spoon 25, and protective cover 55 may be made of a food grade plastic using injection molding techniques, or with any other suitable material and manufacturing method known to those skilled in the art.

The present invention has been described in an illustrative manner. It is understood that the terminology which has been used is intended to be in the nature of words of description rather than limitation. As such, many modifications and variations of the present invention are possible in light of the above teachings.

The invention claimed is:

1. An assembly comprising:

a flexible pouch having a pair of top edges;

a fitment having a canoe portion and a spout portion, the canoe portion mounted to the pair of edges of the pouch, the spout portion extending in a direction away from the pouch, the fitment having a passage extending through the canoe portion and the spout portion;

and a spoon having a scoop portion and a handle portion, the scoop portion of the spoon supported above the spout portion and the handle portion fully received in the passage.

2. The assembly of claim 1 wherein the spoon is supported to the fitment by one or more frangible ribbons.

3. The assembly of claim 1 wherein the handle portion having an extendable concertina design.

4. The assembly of claim 1 further comprising:

a protective cover secured to the fitment, the protective cover covering a portion of the spoon that is not disposed within the passage.

5. The assembly of claim 4 wherein the protective cover includes a first half and a second half.

6. The assembly of claim 5 wherein the first half and second half are attached to each other by a top hinge, the first half being secured to the fitment by way of a safety seal such that the safety seal can be removed to detach the first half from the fitment and the first half pivoted about the top hinge to provide access to the spoon.

7. The assembly of claim 5 wherein the first half is attached to the fitment by a bottom hinge, and the second half is attached to the fitment by another bottom hinge, the first half is attached to the second half by way of a safety seal such that the safety seal can be removed to detach the first half from the second half and the first and second halves pivoted about the bottom hinges to provide access to the spoon.

8. The assembly of claim 6 wherein the first half or the second half has a generally hemispherical shape.

9. The assembly of claim 7 wherein the first half and the second half are generally hemispherical in shape.

10. An assembly for a flexible pouch with a pair of top edges comprising:

a fitment having a canoe portion and a spout portion, the canoe portion mounted to the pair of edges of the pouch, the spout portion extending in a direction away from the pouch, the fitment having a passage extending through the canoe portion and the spout portion; and a spoon supported in a generally vertical alignment in the passage, the spoon having a handle portion and a scoop portion, a protective cover encapsulating the scoop portion of the spoon, the protective cover having a first half and a second half, the first half and second half attached to each other by a top hinge, the first half being secured to the fitment.

11. The assembly of claim 10 wherein the protective cover is attached by way of a safety seal such that the safety seal can be removed to detach the first half from the fitment, the first half pivoted about the top hinge to provide access to the scoop portion of the spoon.

12. An assembly comprising:

a flexible pouch having a pair of top edges;

a fitment having a canoe portion and a spout portion, the canoe portion mounted to the pair of edges of the pouch, the spout portion extending in a direction away from the pouch, the fitment having a passage extending through the canoe portion and the spout portion; and a spoon removably supported to the fitment by one or more frangible ribbons, the spoon supported in a generally vertical alignment in the passage with a handle extending into the passage.

13. The assembly of claim 12 wherein the handle portion having an extendable concertina design.

14. The assembly of claim 12 further comprising:

a protective cover secured to the fitment, the protective cover covering a portion of the spoon that is not disposed within the passage.

15. The assembly of claim 14 wherein the protective cover includes a first half and a second half.

16. The assembly of claim 15 wherein the first half and second half are attached to each other by a top hinge, the first half being secured to the fitment by way of a safety seal such that the safety seal can be removed to detach the first half from the fitment and the first half pivoted about the top hinge to provide access to the spoon.

17. The assembly of claim 15 wherein the first half is attached to the fitment by a bottom hinge, and the second half is attached to the fitment by another bottom hinge, the first half is attached to the second half by way of a safety seal such that the safety seal can be removed to detach the first half from the second half and the first and second halves pivoted about the bottom hinges to provide access to the spoon.

18. The assembly of claim 16 wherein the first half or the second half has a generally hemispherical shape.

19. The assembly of claim 17 wherein the first half and the second half are generally hemispherical in shape.

* * * * *